United States Patent [19]

Barlow

[11] Patent Number: 4,848,768

[45] Date of Patent: Jul. 18, 1989

[54] SPINNING LIGHTED TOY

[75] Inventor: Gordon A. Barlow, Highland Park, Ill.

[73] Assignee: Gordon Barlow Design, Skokie, Ill.

[21] Appl. No.: 281,274

[22] Filed: Dec. 8, 1988

[51] Int. Cl.[4] ..... A63F 3/00; A63F 5/04

[52] U.S. Cl. ..... 273/141 A; 273/273

[58] Field of Search ..... 273/141 A, 142 A, 142 B, 273/273, 237

[56] References Cited

U.S. PATENT DOCUMENTS

| | | | |
|---|---|---|---|
| 2,320,347 | 6/1943 | Brosseau et al. | 273/118 A X |
| 3,210,081 | 10/1965 | Rapaport | 273/141 A |
| 3,834,711 | 9/1974 | Breslow | 273/141 A |
| 4,171,813 | 10/1979 | Kuna et al. | 273/141 A X |

*Primary Examiner*—Anton O. Oechsle

*Attorney, Agent, or Firm*—Kinzer, Plyer, Dorn, McEachran & Jambor

[57] ABSTRACT

A toy spinner in the shape of a birthday cake which uses sequentially flashing lights to duplicate the rotational movement of a pointer and also provides a clicking sound characteristic of a carnival-type fortune wheel. The spinner has a turntable which carries a single light bulb which sequentially illuminates a series of lamps arranged in a circle to mimic the action of a rotating pointer. Rotation of the turntable activates an electrical circuit which remains activated after the turntable stops for a dwell period to indicate by a lighted bulb the segment at which the pointer has stopped. The spinner may be used with a game board and markers. Indicia on the segments are tied into the markers and indicia on the markers are related to elements on the game board.

4 Claims, 2 Drawing Sheets

SPINNING LIGHTED TOY

BACKGROUND AND SUMMARY OF THE INVENTION

Spinners and gaming wheels are commonly used as amusement devices either alone or with other apparatus such as game boards or playing cards. The spinners can be as simple as a piece of cardboard with a rotating pointer or as complicated as a carnival fortune wheel having pegs separating the outer periphery of the wheel into segments and with a finger that rides on the pegs stopping to point out the winning segment. The traditional carnival fortune wheel produces a characteristic clicking sound as the finger rides over the pegs drawing the attention and interest of the spectators to the winning segment.

This invention is directed to a toy spinner which uses sequentially flashing lights to duplicate the rotational movement of a pointer and also provides a clicking sound characteristic of a carnival-type fortune wheel. The final resting place of the pointer is indicated by a light that remains on for a short interval after the flashing light pointer comes to a rest.

An object of this invention is a toy spinner which replaces the conventional pointer or clicking finger with lights that appear to flash in rotational sequence to mimic the action of a rotating pointer.

Another object of this invention is a spinner which sequentially illuminates a series of lamps to provide a circular motion of a flashing lamp using a single, rotating bulb.

Another object of this invention is a rotating sequence of flashing bulbs that mimics the movement of a pointer which can be rotated either clockwise or counterclockwise.

Another object of this invention is a spinner in which the rotation thereof activates an electrical circuit which remains activated after the spinner stops for a dwell period to indicate to the players by a lighted lamp which segment the pointer has stopped at.

Another object of this invention is a spinner which can be used with a game board and markers in which the players select markers for placement on the game board in accordance with the stopping position of the pointer.

Another object of this invention is a spinner which can be made to resemble a conventional item such as a birthday cake, a clock, a compass, etc.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
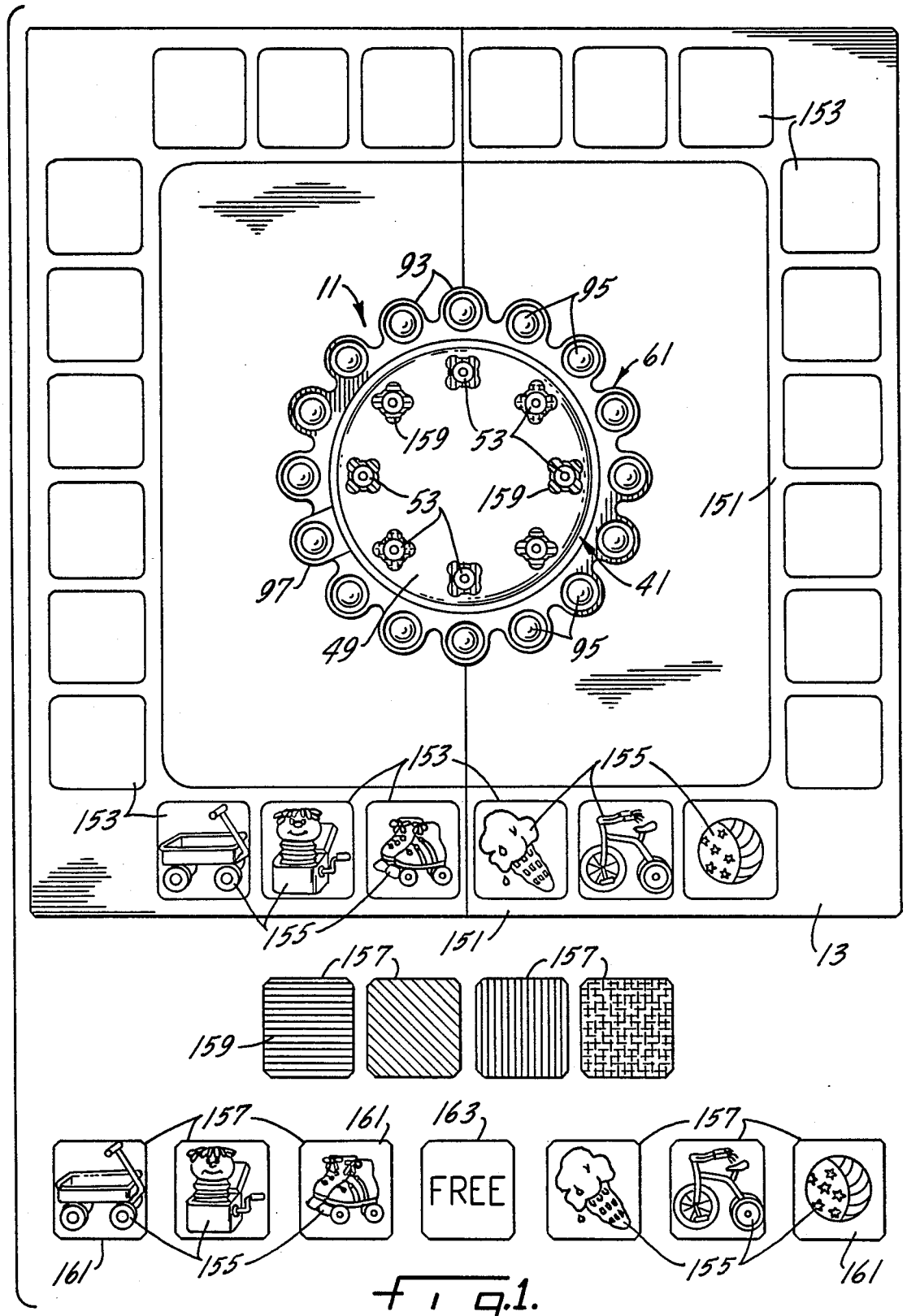
FIG. 1 is a top plan view of a spinner involving the novel features of this invention installed on a game board.
Figure 2:
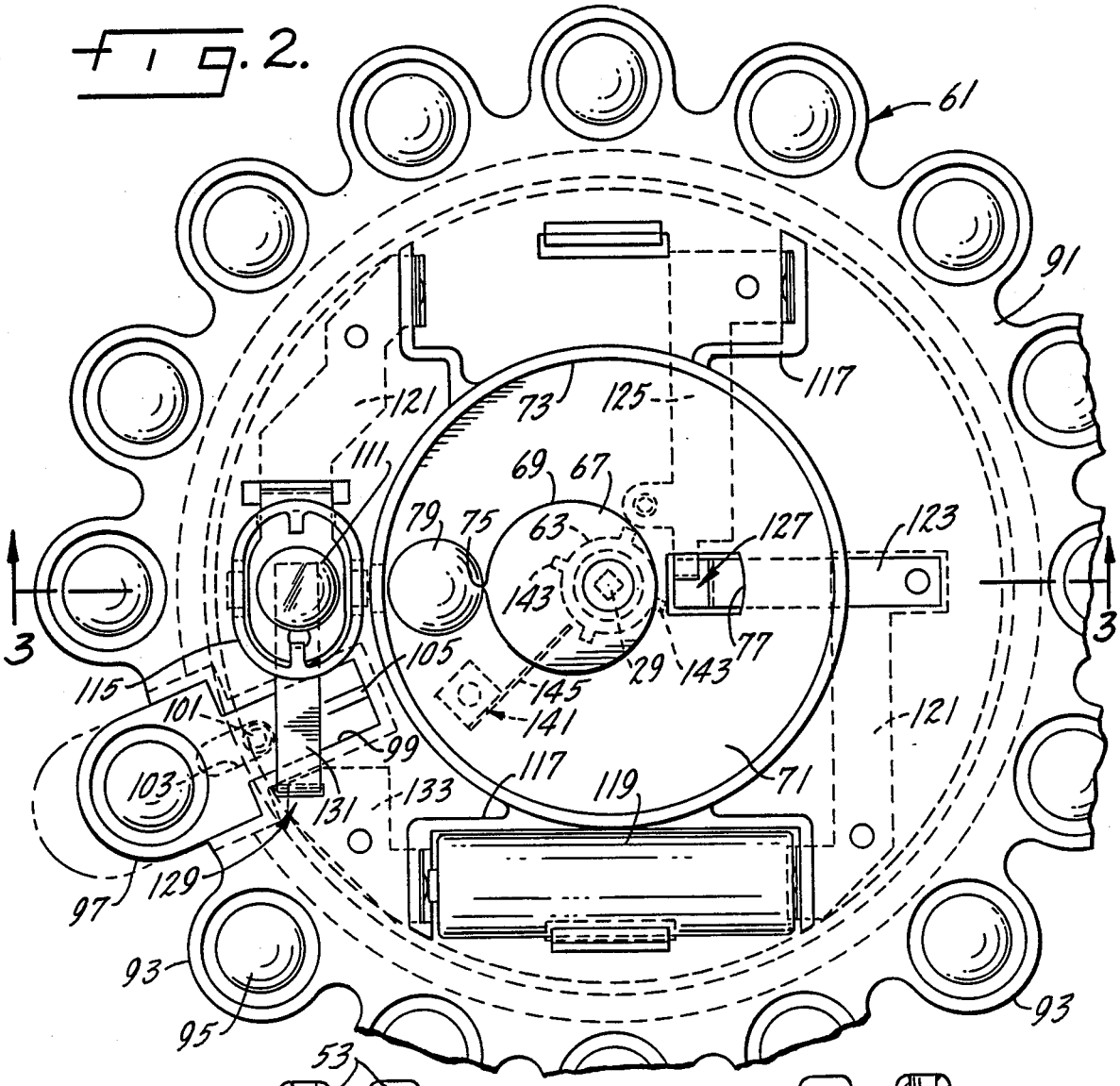
FIG. 2 is a top plan view of the spinner of FIG. 1 with the top cover removed, some parts broken away and others shown in dashed lines.
Figure 3:
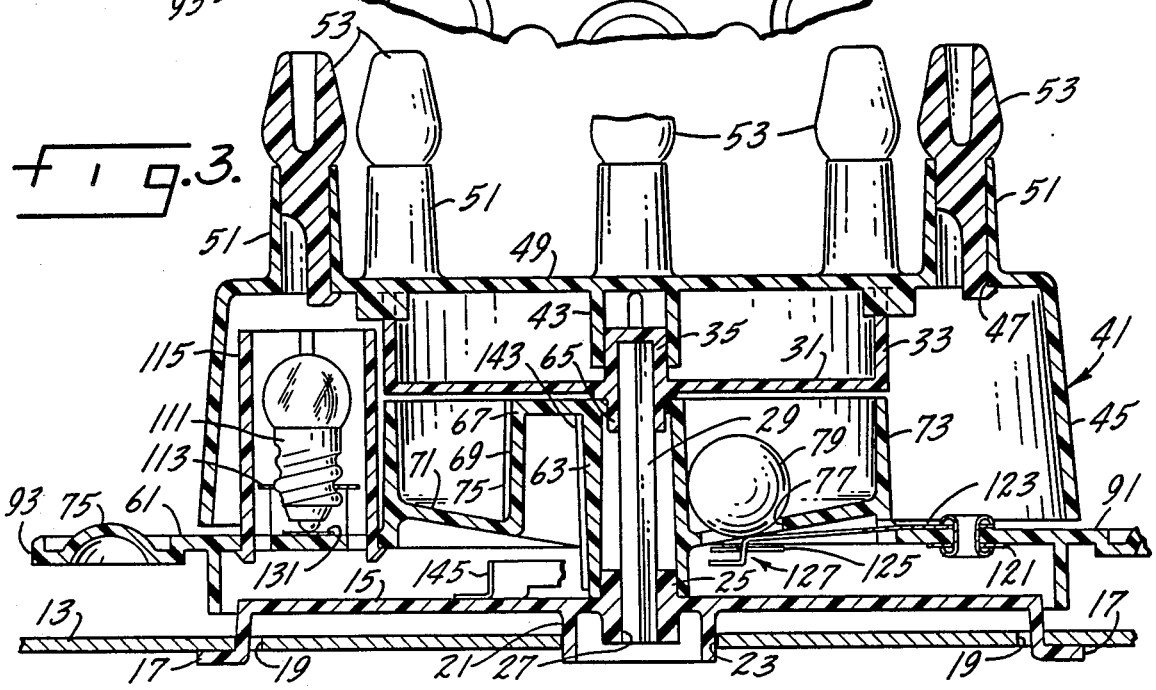
FIG. 3 is a partial, cross-sectional view taken along line 3—3 of FIG. 2 but showing the switch actuating sphere on the opposite side of the inclined track.

FIG. 1 of the drawings shows a spinning toy 11 of this invention in the shape of a traditional birthday cake supported on a game board 13. As shown in FIG. 3, the spinning top has a base 15 with L-shaped feet 17 which fit into bayonet-shaped slots 19 formed in the game board. The base 15 also has a depending collar 21 which is seated in an opening 23 formed in the game board. Upstanding on the base is a hub 25 having a central opening 27 in which is seated an upstanding steel shaft 29. A circular cap 31 made of plastic is mounted on the top of the steel shaft. The circular cap has an upstanding rim 33 formed around the periphery thereof and an upstanding hub 35 at the center of the cap.

A decorative cover 41 is seated on the circular cap 31, resting on the upstanding rim 33 and having a downwardly-depending tubular socket 43 which is seated on the upstanding hub 35 of the circular cap. The decorative cover has a depending skirt 45 and a series of openings 47 in the top surface 49 of the cover. The openings 47 are arranged in a circle around the periphery of the top surface and each has its own sleeve 51 which is formed integrally with the top surface 49 of the cover. A globe 53 of light-transmitting plastic, such as LUCITE, is seated in each sleeve. The decorative cover 41 and its globes 53 are designed to replicate a birthday cake and its candles. It should be understood and appreciated that the decorative cover could also be in the shape of a clock, a compass, a gaming wheel or any other similar decorative item.

A turntable 61 having a central spindle 63 is mounted for rotation around the steel shaft 27 between the hub 25 of the base and a depending hub 65 of the circular cab 31. The turntable has a central monitor 67 which is eccentric to the spindle 63. The monitor has an outer circular wall 69. Attached to the lower end of this wall is an inclined annular ramp 71 which is bordered on the outside by an upstanding wall 73. An upstanding rib 75 is located on the outer circular wall 69 of the monitor at the high point of the inclined annular ramp 71. An opening 77 is formed in the inclined annular ramp 71 at the low point thereof which is diametrically opposite to the rib 75. The opening is large enough so that a sphere 79, which may be formed of metal or glass, can seat in the opening but cannot pass through.

An annular ledge 91 extends radially outwardly from the bottom of the upstanding wall 73 of the turntable 61. This ledge terminates at its outer end in finger-like projections 93, which are generally uniformly spaced around the periphery of the annular ledge 91. Each finger has an upwardly-projecting bubble 95 formed therein which enables a user to grasp and turn the turntable 61. At one location in the periphery of the annular ledge 91, a fixed finger 93 is omitted and a slidable, separate finger 97 is installed to slide in a notch 99 formed in the annular ledge. The finger is secured for sliding movement by a screw 101 which fits through an elongated slot 103 formed in the annular ledge. The finger 97 has a ramp 105 formed integrally on the top thereof to open and close electrical contacts in a manner to be described hereinafter.

An electric light bulb 111 is mounted in a holder 113, which is supported on the annular ledge 91 of the turntable 61 inwardly of the depending skirt 45 of the decorative cover 41. A shield 115 surrounds the light bulb so that its light is directed only upwardly through the globes 53 located in the sleeves 51 of the decorative cover 41. A pair of battery holders 117 are formed integrally with the turntable 61 and are located diametrically from each other outwardly of the outer circular wall 69 surrounding the inclined annular ramp 71. The battery holders are design to hold AA size batteries, indicated as 119; although, of course, other types of batteries may be used. Strip electrical contacts, generally indicated at 121, extend between the batteries, the bulbs and the finger switch 97. Additionally, a pair of overlapping contacts 123 and 125 form a normally closed switch 127 located below the opening 77 at the low point of the inclined annular ramp 71. When the sphere 79 is seated in this opening, it will rest on the contact 123, pushing it away from the contact 125 and thus interrupting the circuit. Another switch 129 is provided at the separate finger 97 and includes a contact 131 connected to the base of the bulb and a contact 133 connected to one of the batteries 119. The ramp 105 on top of the finger 97 lifts the contact 131 from engagement with the contact 133 when the finger is pulled outwardly to interrupt the circuit and shut off the power to the light bulb 111.

A sound-making mechanism 141 includes ribs 143, four of which are located around the outer periphery of the central spindle 63 and which engage a metal arm 145 fixed to the base 115 to provide a clicking noise as the turntable 61 is spun.

When the turntable 61 is at rest, the sphere 79 will be seated in the opening 77 at the low point of the inclined annular ramp 71, as shown in FIG. 3, opening the switch 127 and interrupting the circuit between the batteries and the bulb. When the turntable is turned, the sphere 79 will be rotated around the inclined annular ramp 71 away from the opening 77, closing the circuit and allowing the bulb 111 to be lighted with current supplied by the batteries. As the turntable and lighted bulb 111 rotate, the globes 53 will be lighted in sequence. When the turntable comes to a stop, the bulb 111 will be located under one of the globes 53. The bulb 111 will remain lighted for a dwell time until the sphere 79 rolls back to the low point opening 77 in the ramp to interrupt the electrical circuit and extinguish the bulb 111. This dwell time enables the player to determine which is the selected globe 53. Each globe 53 can be tied into winning numbers, colors, etc. The interest of the players in determining which globe 53 will be lighted as the turntable comes to a stop is heightened by the sound mechanism 141 which makes a clicking noise so long as the turntable is turning.

The game board 13 may be formed in the shape of a square. When the decorative cover 41 depicts a birthday cake, each peripheral side 151 of the square game board may be divided into squares 153, with each square containing an illustration of an object which is considered a traditional birthday present for a child. Each side 151 of the square game board contains the same series of illustrations 155, although illustrations are shown on only one side of the board of FIG. 1 for simplicity of disclosure. Markers 157, which may be conveniently made in the form of small, thin rectangular cards of approximately the same size as the squares 153, are provided. In the disclosed embodiment of the invention, the markers 157 are divided into four different sets. In each set, one side of a marker carries a distinctive indicia 159 such as a color. The same indicia 159 is applied to the top surface 49 of the decorative cover at the base of a sleeve 51 and a globe 53, which sleeve and globe simulate a candle. Because eight candles and four sets of markers are used in the game, pairs of diametrically-opposed candles are marked with the same indicia 159. The other side 161 of each marker of a set carries one of the illustrations 155 contained in the square located along each side of the game board. If six illustrations are provided on each side of the game board, six illustrations are provided for each set of markers. Of course, additional marks such as "wild cards" 163 may be provided for each set of markers.

When the turntable 61 stops spinning after rotation by a player, a globe 53, which remains lighted for a dwell interval after the rotation stops, indicates the particular indicia selected. The player who has spun the turntable selects a marker bearing this indicia and places the marker on one of the squares on his side of the board which contains the same illustration. The first player to select markers which match all of the illustrations on his side of the game board is considered the winner of the game.

I claim:

1. A game including:

a base, a turntable mounted for rotation on said base, means formed on the turntable for grasping it to rotate it, a light bulb carried on said turntable for movement in a circle, a fixed cover mounted over said turntable, a series of openings formed in said cover and arranged in a circle in alignment with the path of movement of said light bulb, a source of electrical power, an electrical circuit connecting said light bulb and said source of electrical power, and switching means located in said electrical circuit and formed and adapted to interrupt said circuit when said turntable is at rest and to complete said circuit when said turntable is rotated and to remain completed for an interval after the turntable ceases rotating.

2. The game of claim 1 in which a light-transmitting plastic rod is installed in each opening in the fixed cover.

3. The game of claim 1 in which said switching means includes normally closed contacts located in said electrical circuit, means to open said normally closed contacts to interrupt said circuit including a ramp surface formed as part of said turntable and having a low point with said normally closed contacts positioned at said low point, a sphere positioned on said ramp surface to rest on and open said closed contacts when said turntable is at rest, said sphere being moved away from said low point of said ramp by centrifugal force when said turntable is rotated and will eventually roll back to said low point to open said closed contacts when said turntable stops rotating.

4. The game of claim 3 in which said ramp surface is annular in shape and is eccentrically located relative to the center of the turntable.

* * * * *